US006929210B2

(12) United States Patent
Sandler et al.

(10) Patent No.: US 6,929,210 B2
(45) Date of Patent: Aug. 16, 2005

(54) FIBER PAYOUT FOLLOWER

(75) Inventors: Reuben Sandler, Berkeley, CA (US); Jon Burns, Richmond, CA (US); Alexander Charles White, Fairfield, CA (US); Bjorn Monteen, San Rafael, CA (US); Jesse Thomas, Oakland, CA (US); Nathan H. Harding, San Francisco, CA (US)

(73) Assignee: Berkeley Process Control, Inc., Berkeley, CA (US)

( * ) Notice: Subject to any disclaimer, the term of this patent is extended or adjusted under 35 U.S.C. 154(b) by 0 days.

(21) Appl. No.: 10/665,977

(22) Filed: Sep. 19, 2003

(65) Prior Publication Data

US 2004/0118965 A1 Jun. 24, 2004

Related U.S. Application Data

(60) Provisional application No. 60/412,238, filed on Sep. 19, 2002, and provisional application No. 60/415,613, filed on Oct. 1, 2002.

(51) Int. Cl.[7] ..... B65H 54/28; B65H 43/00

(52) U.S. Cl. ..... 242/478.2; 242/563.1; 242/566; 242/615.1

(58) Field of Search ..... 242/478.2, 563.1, 242/566, 615.1, 615.2, 157.1

(56) References Cited

U.S. PATENT DOCUMENTS 3,568,904 A * 3/1971 Kurz ..... 226/15
3,570,735 A * 3/1971 Kurz ..... 226/3
4,077,579 A * 3/1978 Seleski et al. ..... 242/563.1
4,655,410 A * 4/1987 Ruffin et al. ..... 242/478.2
4,695,010 A * 9/1987 Smith ..... 242/478.2
5,590,846 A * 1/1997 Dekel ..... 242/478.2
5,881,965 A * 3/1999 Doell et al. ..... 242/563.1
5,921,452 A * 7/1999 Wulf et al. ..... 226/21
6,073,878 A * 6/2000 Egglhuber ..... 242/478.2
6,659,386 B1 * 12/2003 Rienas ..... 242/478.2

FOREIGN PATENT DOCUMENTS

JP 04292377 A * 10/1992 ..... B65H/54/28

* cited by examiner

*Primary Examiner*—Kathy Matecki
*Assistant Examiner*—Evan H Langdon
(74) *Attorney, Agent, or Firm*—Pillsbury Winthrop Shaw Pittman LLP; David Jeffer

(57) ABSTRACT

A follower apparatus mounted on a track running parallel to an axis of rotation of a spool. The apparatus has a base with a roller mounted thereon and having an axis of rotation parallel to the rotational axis of the spool, the roller providing support and guidance to the material being wound. A pulley is rotatably mounted to receive material from the roller and redirect the direction of material traveled. Light beams and detection apparatus are positioned to detect material excursions to pre-determined off center portions of the roller. The follower positioning apparatus responds to signals detecting the material by repositioning the follower to place the material back on to a center zone of the roller.

6 Claims, 8 Drawing Sheets

ENLARGEMENT B

FIBER PAYOUT FOLLOWER

This application claims priority from provisional U.S. patent application Ser. No. 60/412,238 filed Sep. 19, 2002 and provisional U.S. patent application Ser. No. 60/415,613 filed Oct. 1, 2002.

BACKGROUND OF THE INVENTION

1. Field of the Invention

The present invention relates to an apparatus for unwinding fiber from a spool, and most particularly to a fiber spooling machine that uses an optical sensing method to detect the fiber position as it is unwound from a spinning spool and automatically positions itself to be aligned with the fiber.

2. Description of the Prior Art

In a fiber (or wire) spooling machine, which unwinds the fiber from a payout spool and rewinds it onto a take-up spool, a device that tracks the position of the fiber as it comes off the payout spool is often required. This device is referred to as a follower and ensures that the path of the fiber coming off the spool is perpendicular with respect to the spool's axis of rotation. This is advantageous for preventing fiber (or wire) damage, which could occur if the angle between the fiber path and the spool axis becomes too large, as the fiber would then be dragged over adjacent wraps.

On a system that only unwound spools with a known and consistent fiber wind pitch and known and consistent spool dimensions, a spooling machine design would be trivial. A follower on such a system could consist of a spinning pulley mounted on a linear slide that would move back and forth, parallel to the spool axis at a known distance and at the specified pitch. Wound spools with known and consistent fiber winding pitch and spool dimensions are rarely the case. Many variables can complicate the required operation of a follower. First, the fiber pitch often varies between spools and on a single spool. Spool flange dimensions vary due to wear or manufacturing tolerances. The follower linear axis is also often set up incorrectly with respect to the position of the spools. In order to compensate for these variations the follower would need to adaptively position itself based on the actual position and angle of the fiber as it comes off the payout spool.

SUMMARY

It is an object of the present invention to provide an improved apparatus for detecting the position of material unwinding from a spool using an optical sensing method.

It is a further object of the present invention to provide a follower apparatus that guides the material unwinding from a spool along a desired path utilizing a roller.

It is a still further object of the present invention to provide a follower apparatus that enables the position of material to be accurately tracked at any line speed with any pitch regardless of the variations in the spool without damaging the fiber or losing its position.

Briefly, a preferred embodiment of the present invention includes a follower apparatus mounted on a track running parallel to an axis of rotation of a spool. The apparatus has a base, with a roller mounted thereon having an axis of rotation parallel to the rotational axis of the spool, the roller providing support and guidance to the material being unwound from the spool. A pulley is rotatably mounted to receive material from the roller and redirect the direction of material travel. Light beam and detection apparatus detect when the material moves out of a selected/center zone of the roller and provide a corresponding signal. A follower positioning apparatus responds to the signal by repositioning the follower to place the material back into the center zone of the roller.

IN THE DRAWING

Figure 6A:
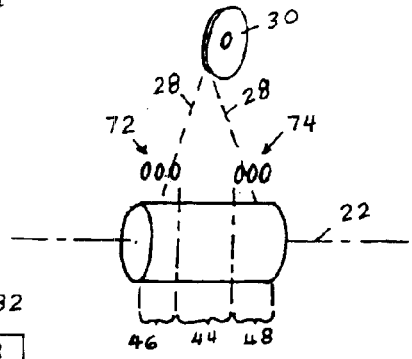
Figure 6B:
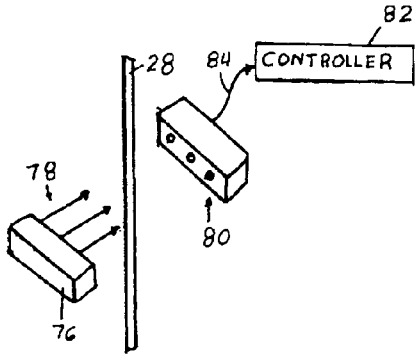
Figure 6C:
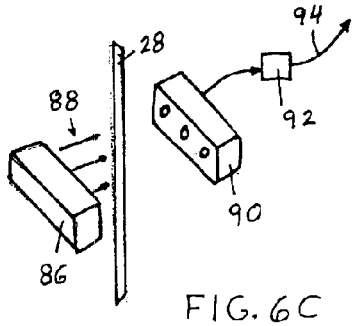
Figure 5A:
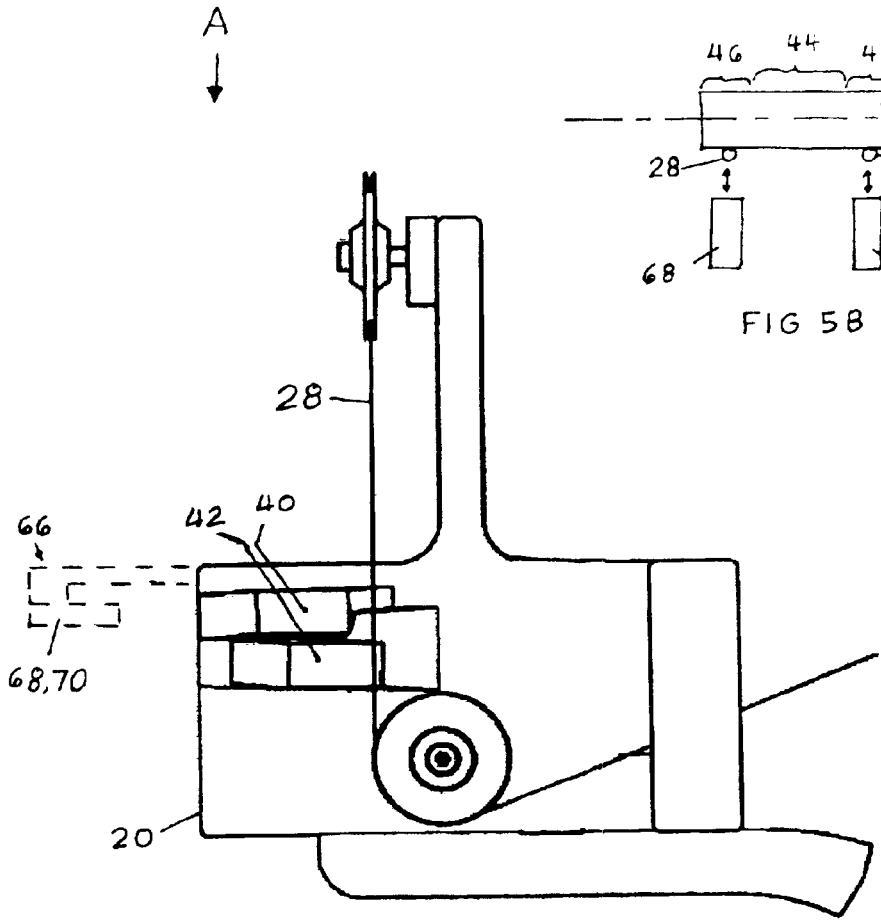
FIG. 5A is a side planar view of the follower, and illustrates an alternate placement of sensor apparatus.
Figure 5B:
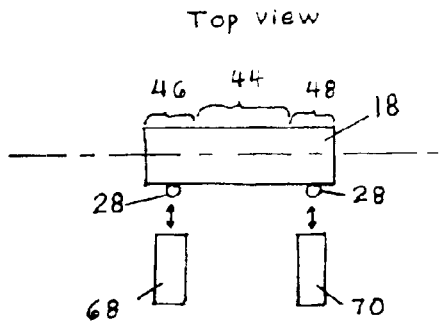
Figure 7:
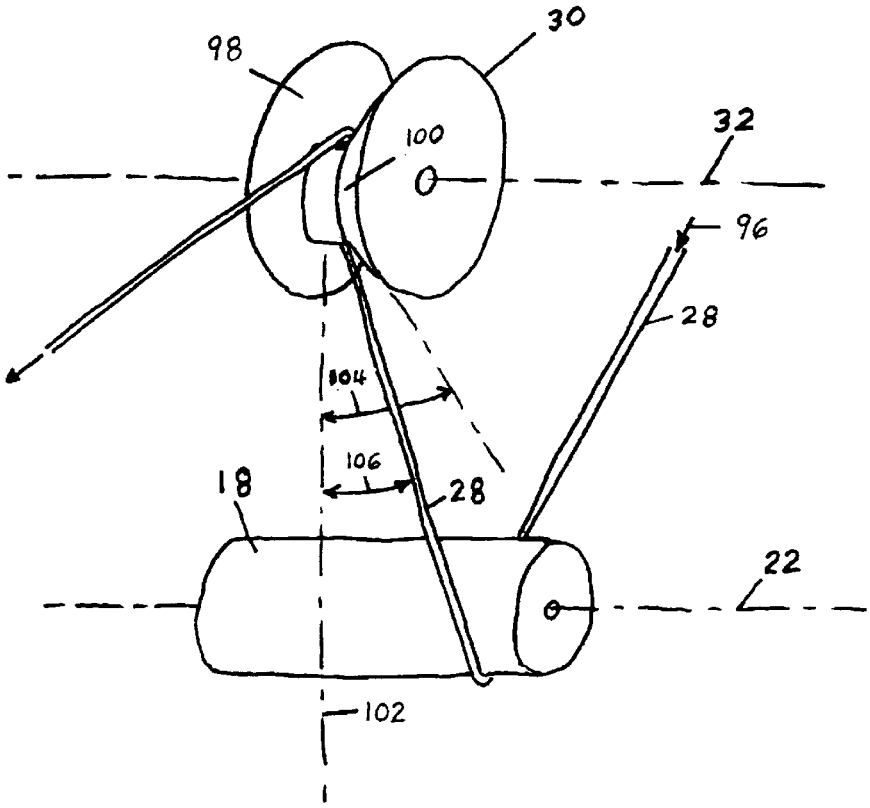
Figure 8:
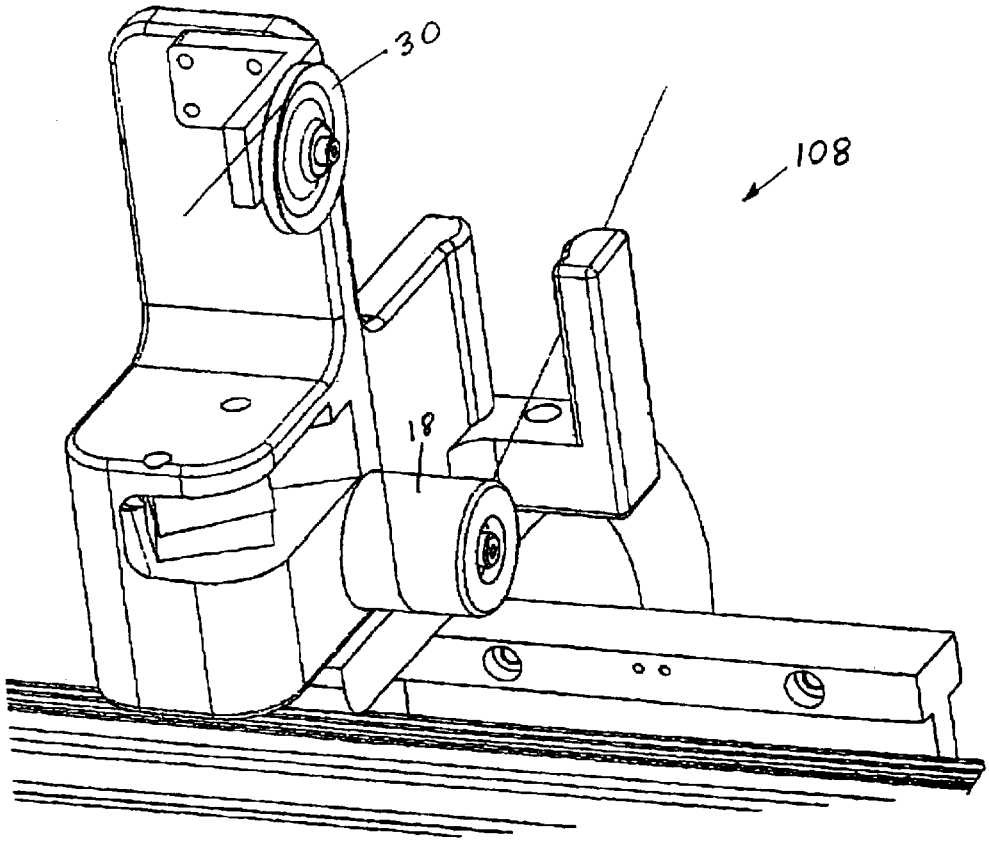
Figure 9A:
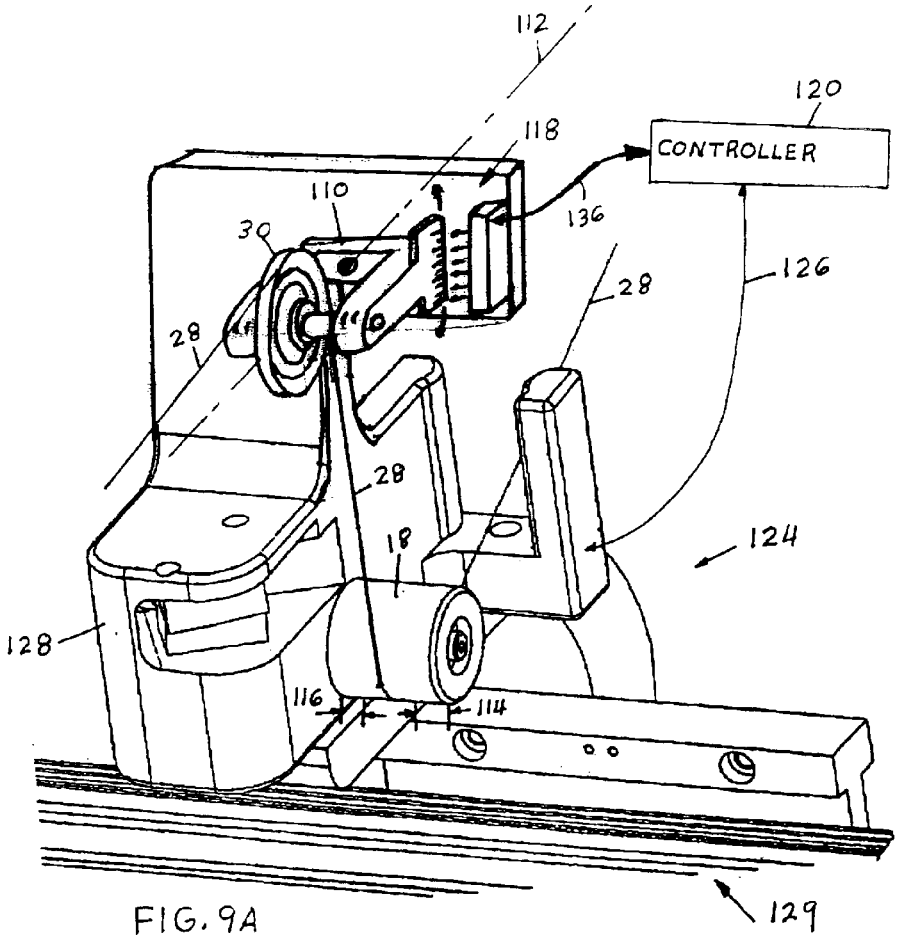
Figure 9B:
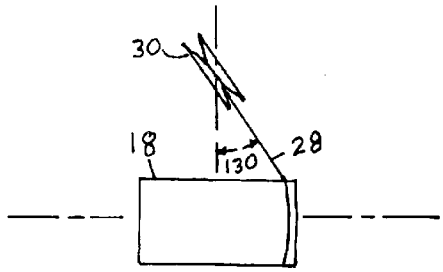
Figure 10:
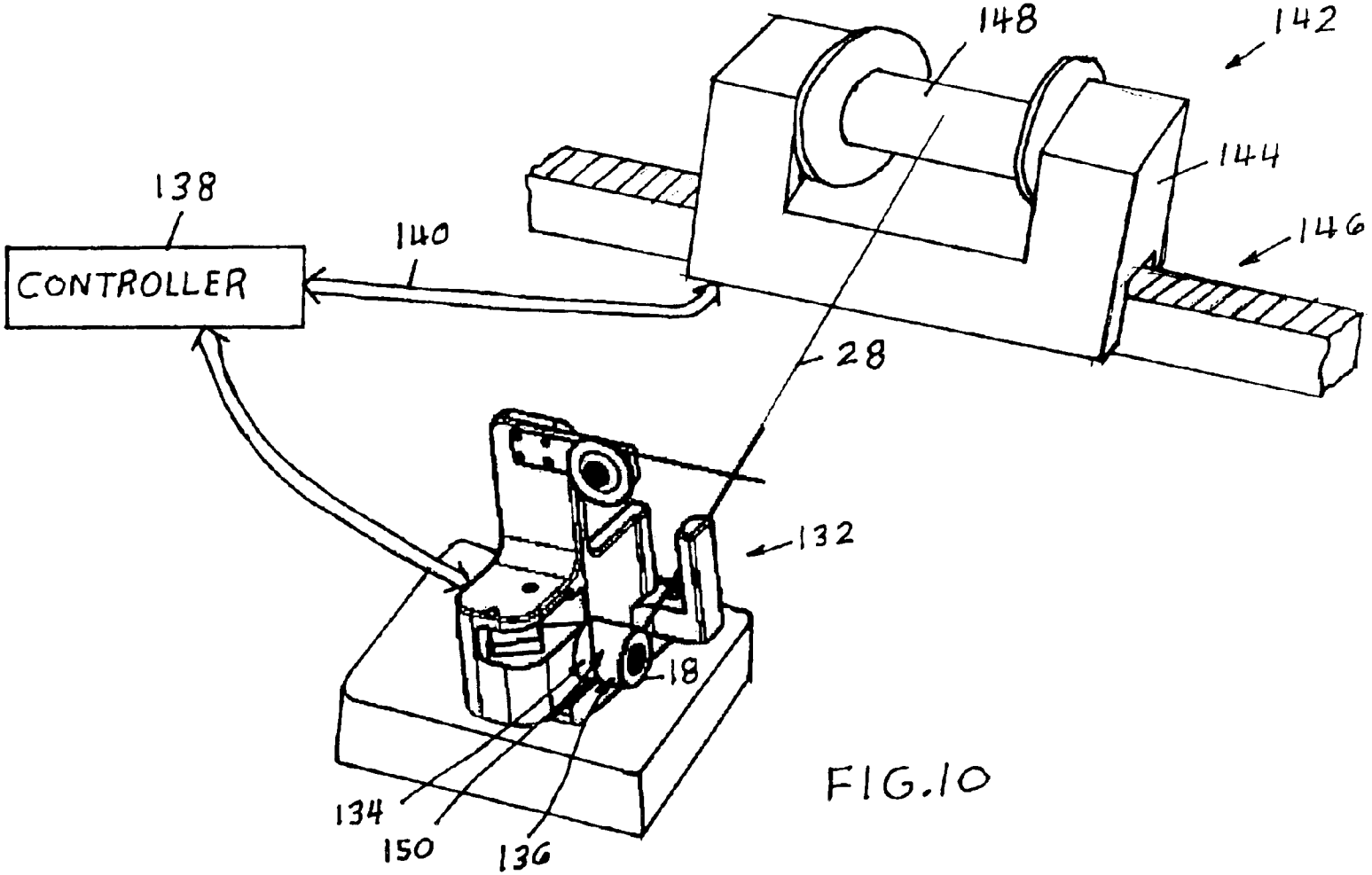

FIG. 5B further illustrates the alternate sensor apparatus of FIG. 5A;

FIG. 6A illustrates sensor apparatus with multiple reflective emitter-detectors;

FIG. 6B illustrates sensor apparatus using transmissive detection;

FIG. 6C shows a sensor apparatus using a columator;

FIG. 7 illustrates a pulley mounted with its axis parallel to the axis of the roller;

FIG. 8 shows more detail of a follower module with the pulley oriented as shown in FIG. 7;

FIG. 9A is a perspective view showing a material position sensor apparatus based on a pulley angle measurement;

FIG. 9B is a drawing further illustrating the angle measurement of FIG. 9A; and FIG. 10 illustrates an embodiment wherein the payout spool position is adjusted instead of the follower module position.

DETAILED DESCRIPTION OF THE PREFERRED EMBODIMENT

Figure 1:
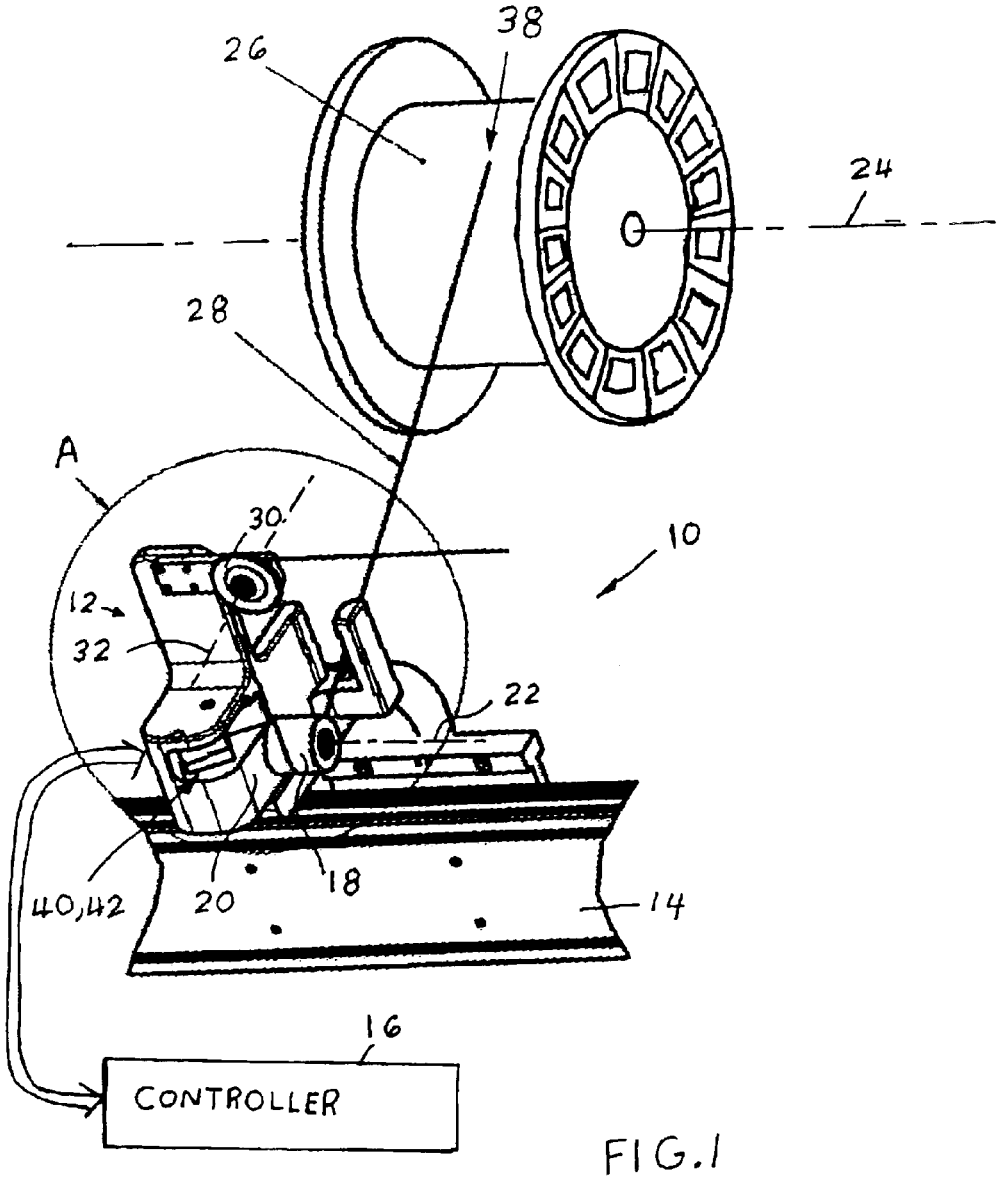
FIG. 1 shows a follower apparatus according to the present invention guiding material being unwound from a spool.

FIG. 1 illustrates a follower apparatus 10 according to the present invention. The apparatus 10 includes a material follower module 12, a track 14 and a controller apparatus 16. The term "motorized" will be used in the present specification and refers to any method providing movement of the module 12 of FIG. 1, or of the spool module 144 of FIG. 10 which will be described in the following text of the specification. For example, the apparatus could be a piston attached to the module 12, and wherein the motor for moving the piston could be remotely located from the module itself. The module 12 or spool module 144 could also be mounted on an articulating arm propelled by a motor. The present invention is intended to include the various alternative constructions that will be apparent to those skilled in the art upon reading the present disclosure.

Figure 2:
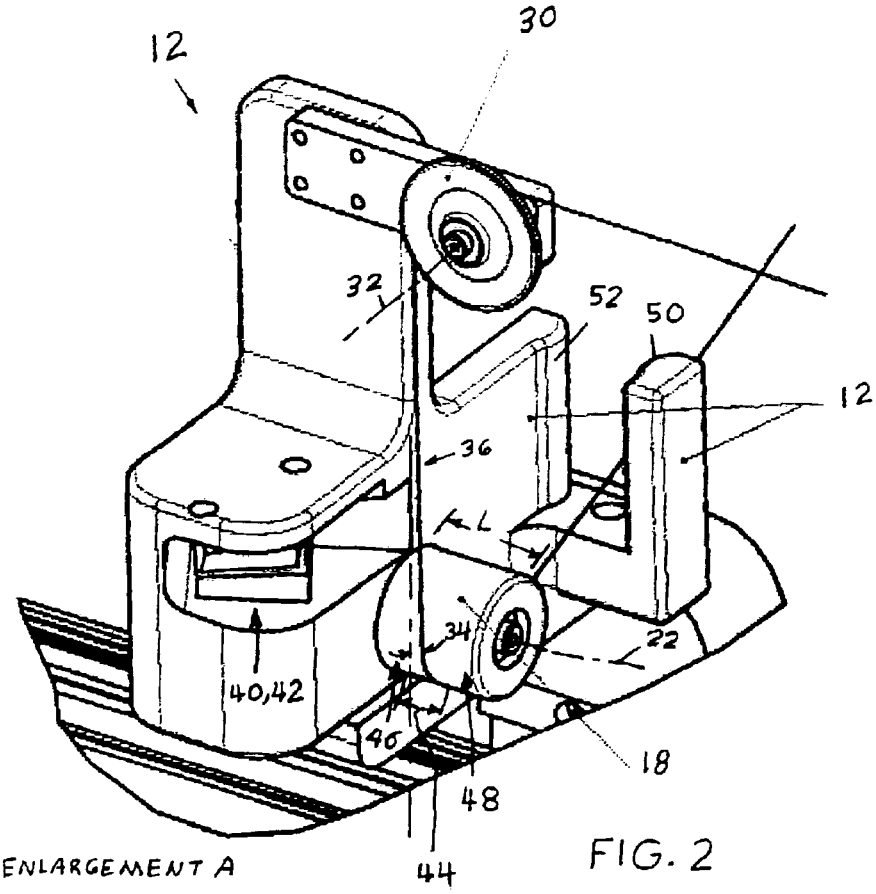
FIG. 2 is an enlarged view of the follower apparatus of FIG. 1.
Figure 3:
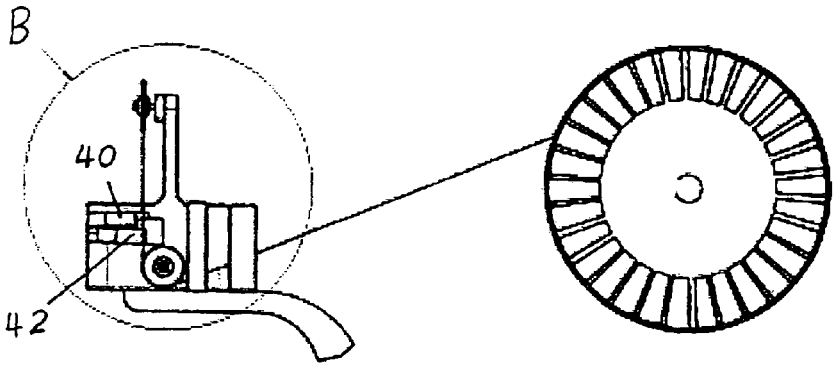
FIG. 3 is a side planar view of the follower apparatus and a spool.
Figure 4:
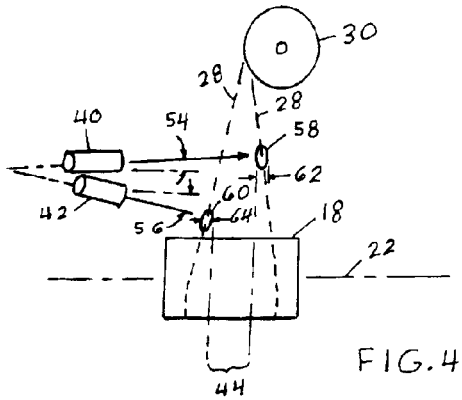
FIG. 4 is an illustration of angled sensor apparatus.

Referring again to the embodiment of FIG. 1, the follower module 12 includes a freely spinning roller 18, (mounted on a base 20) with an axis of rotation 22 of the roller 18 parallel to the axis of rotation 24 of a payout spool 26. The material 28 such as a fiber, etc. is redirected by the roller 18 to a pulley 30, that can be mounted with its axis of rotation 32 at an angle to the roller axis 22. Embodiments with the pulley 30 axis 32 perpendicular and embodiments with the axis 32 parallel to the roller 18 axis 22 will be described in detail in the following text, but the present invention also includes other angles. The material 28 is redirected by the pulley 30 and runs to the next pulley or other apparatus in the system. If the pulley 30 axis 32 is perpendicular to the roller axis 22, the pulley 30 is aligned such that the plane it rotates in, which is perpendicular to the axis of rotation 32, and the plane that the fiber is guided along, is tangent to the surface of the roller 18. This ensures that the material 28 will not rub on the pulley walls. The material 28 can run anywhere along the length of the roller 18 depending on the position of the follower 12 with respect to where the fiber unwraps from the spool 26. Thus, the angle 34 (FIG. 2) of the segment 36 of material 28 between the roller 18 and pulley 30 changes depending on the follower 12 position relative to the point 38 that the fiber leaves the payout spool 26. FIGS. 3, 4 and 5 show two fiber presence sensors 40 and 42, which detect the presence of the material 28 in side zones 46 and 48 on the roller 18 by emitting a light beam and detecting light reflected when the material 28 moves out of a selected zone 44, which will also be referred to as a center zone, and into the path of the light beam. The two sensors 40 or 42 detect in side zones 46 and 48, leaving a "dead-band" center zone 44 in the center of the roller 18. Neither sensor 40 or 42 can detect the material 28 in the center zone 44. When the fiber moves out of the center zone 44, far enough from the center to either side zone 46 or 48, the corresponding sensor 40 or 42 will detect its presence, sending a signal to the controller 16 which will direct motorized apparatus associated with the module 12 and track 14 to make an appropriate adjustment in the module 12 along the track 14 to return the material 28 to the center zone 44. The material 28 is prevented from exiting the side zones 46 or 48 by physical stops 50 and 52, that allow the material 28 to bend around the edge of the stop (50 or 52) without breaking. During normal operation, the material 28 will never contact the stops 50 or 52, but they are provided to prevent the material 28 from coming off the roller in case of a failure of one or more sensors 40 or 42, or a poorly wound payout spool 26 with abnormally large material pitch variations. Although the text and figures of the drawing show a center zone 44 and two side zones 46 and 48, the present invention includes any number of zones. The specification also describes only two sensors 40 and 42, but as with the number of zones, these are given by example, and the present invention also includes any number of sensors arranged for sensing the presence of the fiber/material in any number of zones. The three zone model described in detail is a practical embodiment of the present invention that minimizes the number of elements.

The sensors 40 and 42 as shown in FIGS. 1-5A are tilted, with sensor 40 directing a light beam upward from a horizontal direction (FIG. 5A), and sensor 42 directing a light beam downward. The reason for the angles is to direct the laser beams so that they will intersect the material 28 at a direction orthogonal to the material direction of travel. This assures that an optimum signal is reflected back from material to a light detector of the sensor (40, 42). The need for the angled sensors is due to the convenient positioning of the sensors on the base 20, requiring them as shown being displaced at an oblique angle to the direction of the roller 18 axis 22. This arrangement of angles is illustrated in FIG. 4, which is a view looking in a direction orthogonal to the plane of the material 28 and pulley 30. Looking at the sensors 40 and 42 from the view of FIG. 4 places the sensors towards the viewer. This is more clearly illustrated in reference to the perspective views of FIGS. 1 and 2. Sensor 40 is shown directed upward at an angle 54, and sensor 42 downward at an angle 56. Because the sensors are located off the axis 22, towards the viewer, the beam areas 58 and 60 in the planar view of FIG. 4 appear elliptical with widths 62 and 64.

In operation, as the material 28 moves through the beam width 62, a portion of the beam is reflected off of the material, traveling back to the sensor 40 where the reflected signal is detected and gives indication to the controller 16 to move the position of the module 12 to bring the material back into the center zone 44. A similar operation applies when the material moves into the width 64 of beam 60.

Alternatively, an apparatus can be constructed extending for example from the base 20, to position the sensors so as to direct the light beams orthogonal to the plane in which the material 28 moves in the space between the pulley 30 and the roller 18, so that when the material intersects the sensor light beam, the beam is orthogonal to the material regardless of the position of the material 28 on the roller 18.

Referring to FIG. 5A, which is an enlargement of the view of portion B of FIG. 3, the dashed lines 66 illustrate sensors 68 and 70 in the alternative position as described above. FIG. 5B illustrates the arrangement of sensor apparatus 68 and 70 of FIG. 5A as would be observed from a top view indicated by direction arrow "A" in FIG. 5A. The material 28 is shown in both side zones 46 and 48. Referring to FIG. 6A, whether the sensors are positioned as sensors 40 and 42, or as sensors 68 and 70, a still further alternative sensor apparatus can be used that includes a first sensor apparatus for zone 46 and a second sensor apparatus for zone 48, and in this case each sensor apparatus can include a plurality of sensors, and can be mounted to provide a series of beams on each side of the center zone 44. FIG. 6A shows a plurality of beams 72 on one side and a plurality of beams 74 on the other side. Each of the corresponding plurality of sensors can provide a signal to the controller 16 when the sensor's beam is reflected by the material. The controller therefore receives information as to the location of the material in the zones 46 and 48 outside the center zone 44, and the controller 16 can be programmed to adjust the follower position accordingly to bring the material 28 back to the center zone 44.

FIG. 6B illustrates a further alternative embodiment of sensor apparatus wherein a light source 76 is positioned on one side of material 28, and includes one or more light emitters providing corresponding one or more beams 78. A plurality of light sensors 80 are placed on an opposite side of the material 28. When the material 28 intercepts one of the beams 78, it causes a reduction in light arriving at the corresponding one of sensors 80, and this change in detected signal is received by a controller 82 via line 84. The controller 82 then directs the follower to reposition the module 12 so as to center the material 28 on the roller 18. A still further embodiment is indicated in FIG. 6C wherein a bank 86 of a plurality of emitters is placed on one side of material 28 with a light collimator in order to provide a field 88 of collimated light shining in the direction shown. An array of light sensors 90 is placed on the opposite side of material 28, feeding signals to sensor electronics 92 providing detected outputs 94 to a controller. In this case, the sensor electronics can be configured to send a signal to the controller proportional to its position for correcting the follower module 12 position.

Referring again to FIG. 1, the pulley 30 as mentioned above can also be mounted with its axis of rotation 32 parallel with the axis of rotation 22 of the roller 18. The orientation of the pulley 30 and roller 18 in this case is shown in FIG. 7, illustrating the material 28 advancing from a payout spool as indicated by arrow 96. The walls of the pulley 30 may be tapered to avoid interference with the material 28. FIG. 7 simply illustrates the fact that in order to keep the material 28 from rubbing on the walls 98 and 100 of the pulley 30 when the material 28 becomes displaced from the center line 102 of the pulley 30, the angle 104 of the pulley 30 walls 98 and 100 needs to exceed the angle 106 of the material 28. A follower module 108, with the pulley 30 mounted is illustrated in FIG. 8.

FIG. 9A shows an alternative embodiment wherein the pulley 30 is mounted in the orientation as in FIG. 8, but is additionally mounted to a rotational member 110 providing rotation of the pulley around axis 112. As the material 28 moves into one of the side areas 114 or 116, the material causes pulley 30 to rotate about the axis 112 to keep the pulley in line with the material 28 direction. An encoder apparatus 118, symbolically illustrated, can be incorporated to send a signal to a controller 120 via line 136 that is indicative of an angle of rotation of the apparatus 110 and pulley 30 around axis 112. The controller 120 can then respond by directing the follower 124 via line 126 to adjust the follower module 128 position along track 129 so as to bring the material 28 back to the center zone of the roller 18. This angle detection method provides an enhanced sensitivity due to a larger angular movement of the pulley 30, for example than in a system that measures the angle of the material 28 between the spool 26 (FIG. 1) and the follower 10. The enhanced angle of rotation of the pulley 30 is due to the distance between the pulley 30 and roller 18 being shorter than the practical distance between the spool 26 and follower 10. FIG. 9B is a planar view illustrating a severe rotation of the pulley 30 when the material 28 is off to one side of the roller 18. The encoder 118 provides a measure of the angle 130.

A further alternate embodiment of the present invention is illustrated in FIG. 10 wherein a material guide module 132 similar to the follower module of FIG. 1 is mounted in a fixed position. The detection of the fiber 28 position on the roller 18 is the same as described above in reference to module 12 of FIG. 1, etc. and may include any of the material detection methods as described above. When the fiber is detected in one of the side zones 134 or 136, similar to zones 46 and 48 of FIG. 1, the detected signal is received by a controller 138 that responds by outputting a corrective signal on bus 140 to a motorized spool positioning assembly 142. The assembly 142 includes a spool module 144 and track apparatus 146. The assembly 142 responds to the corrective signal on bus 140 by moving the module 144 so as to reposition a spool 148 in a direction to bring the fiber 28 back into the center zone 150 between side zones 134 and 136.

Although the present invention has been described above in terms of a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A follower apparatus for use in guiding material between the follower and a spool, the follower comprising:

(a) a follower module including
  i) a base;
  ii) a roller rotatably attached to said base for guiding said material;
  iii) detection apparatus for detecting when said material is not in a selected zone of said roller and for outputting a corresponding indicative signal, wherein said detection apparatus includes a light emitter and detector apparatus including at least one first emitter and first detector for detecting said material in a first side zone on one side of said selected zone and at least one second emitter and second detector for detecting said material in a second side zone on an opposite side of said selected zone, wherein said first and second emitter and first and second detector are positioned at an oblique angle to a plane defined by a direction of travel of material between said roller and said pulley and a line passing through said material and lying parallel to an axis of rotation of said roller; and;
  iv) a pulley for receiving and redirecting said material from said roller, wherein the axis of rotation of said pulley is oriented parallel to an axis of rotation of said roller;

(b) motorized apparatus for moving said follower module; and (c) control apparatus responsive to said signal for directing said motorized apparatus to move said module into said selected zone.

2. An apparatus as recited in claim 1 wherein each said detector is positioned to detect light reflected from said material.

3. An apparatus as recited in claim 1 wherein each said detector is positioned to detect a reduction in light from a corresponding said emitter caused by said material entering a space between said emitter and said detector.

4. An apparatus as recited in claim 1 wherein said first and second emitter are positioned so as to direct a light beam perpendicular to a direction of travel of said material.

5. An apparatus as recited in claim 1 wherein walls of said pulley are tapered so as to avoid interference with said material.

6. An apparatus as recited in claim 1 wherein said follower module includes first and second physical stops positioned approximate first and second ends of said roller so as to prevent said material from moving past said ends of said roller.

* * * * *